US010948133B2

(12) United States Patent
McMillan

(10) Patent No.: US 10,948,133 B2
(45) Date of Patent: Mar. 16, 2021

(54) RETROFIT LIGHT FIXTURE FOR CEILING SWING FRAME

(71) Applicant: George Erik McMillan, Hickory, NC (US)

(72) Inventor: George Erik McMillan, Hickory, NC (US)

( * ) Notice: Subject to any disclaimer, the term of this patent is extended or adjusted under 35 U.S.C. 154(b) by 0 days.

(21) Appl. No.: 16/586,352

(22) Filed: Sep. 27, 2019

(65) Prior Publication Data

US 2020/0103080 A1 Apr. 2, 2020

Related U.S. Application Data

(60) Provisional application No. 62/737,207, filed on Sep. 27, 2018.

(51) Int. Cl.

| | |
|---|---|
| ***F21K 9/20*** | (2016.01) |
| ***F21S 8/02*** | (2006.01) |
| ***F21K 9/66*** | (2016.01) |
| ***F21V 23/06*** | (2006.01) |
| ***F21V 23/00*** | (2015.01) |
| ***F21Y 115/10*** | (2016.01) |

(52) U.S. Cl.

CPC ..... *F21K 9/20* (2016.08); *F21K 9/66* (2016.08); *F21S 8/026* (2013.01); *F21V 23/003* (2013.01); *F21V 23/06* (2013.01); *F21Y 2115/10* (2016.08)

(58) Field of Classification Search

CPC .... F21K 9/20; F21K 9/66; F21S 8/026; F21V 23/003; F21V 23/06

USPC ..... 362/148

See application file for complete search history.

(56) References Cited

U.S. PATENT DOCUMENTS

| | | | | |
|---|---|---|---|---|
| 2008/0037284 | A1* | 2/2008 | Rudisill | F21S 2/005 362/629 |
| 2010/0254121 | A1* | 10/2010 | Zhou | G02B 6/0055 362/147 |
| 2012/0320627 | A1* | 12/2012 | Araki | F21K 9/275 362/608 |
| 2013/0027916 | A1* | 1/2013 | Caferro | F21V 15/01 362/147 |
| 2014/0056026 | A1* | 2/2014 | Boomgaarden | F21V 29/70 362/609 |
| 2015/0036387 | A1* | 2/2015 | Myers | F21V 15/01 362/646 |
| 2018/0017218 | A1* | 1/2018 | Ham | F21S 8/026 |
| 2018/0098399 | A1* | 4/2018 | Takeshita | F21S 8/024 |
| 2018/0156399 | A1* | 6/2018 | Sorensen | F21S 8/026 |
| 2018/0231710 | A1* | 8/2018 | Snijkers | F21V 19/005 |

* cited by examiner

*Primary Examiner* — Bryon T Gyllstrom

(74) *Attorney, Agent, or Firm* — Ascentage Patent Law, LLC; Travis Lee Johnson

(57) ABSTRACT

In one aspect, a light fixture includes a light source configured to emit light, a driver configured to control operation of the light source and a body housing the light source and the driver. The body is rectangular and configured in length and width so as to slide into a prismatic lens frame of an existing light fixture installed in a ceiling, fill in the frame and be held in place by the frame, where the frame is configured to hold a translucent prismatic lens and close on the existing light fixture. The body of the light fixture is also configured to fit between a body of the existing light fixture and the closed frame. The body is configured in thickness along the perimeter such that the perimeter of the body is able to slide into, fill and be held by the frame.

12 Claims, 14 Drawing Sheets

RETROFIT LIGHT FIXTURE FOR CEILING SWING FRAME

RELATED APPLICATIONS

This application claims priority from U.S. Provisional Appl. No. 62/737,207, filed on Sep. 27, 2018, the contents of which are incorporated herein in their entirety.

TECHNICAL FIELD

The present invention generally relates to ceiling light fixtures, and particularly relates to retrofitting light fixtures with a ceiling swing frame for a prismatic lens.

BACKGROUND

Some ceilings have light fixtures that are covered by a lighting panel (e.g., acrylic prismatic lens) that absorbs some of the light and spreads the rest more evenly. In an example, FIG. 1A shows a perspective view of a standard fluorescent troffer light fixture in a drop down ceiling that is supported by a T-bar grid. In this example, the troffer light fixture is visually surrounded by an external grid frame 110, which may be the grid or a separate frame assembled for the troffer light fixture. The troffer light fixture has a translucent acrylic prismatic lens 130 that covers the lighting elements and is held in a ceiling swing frame 120, which is usually made of metal.

As shown in FIG. 1B, swing frame 120 is attached to the T-bar grid or fixture frame by hinges 140, so that swing frame 120, when unlatched on one side, swings open to reveal troffer body 150 that houses what may be fluorescent tubes 160. Retrofitting these ceiling light fixtures can vary in cost, depending on the type of replacement light fixtures and what is needed to install them.

Some troffer light fixtures are completely removed and replaced with a whole new light fixture. This is a rather involved process that can increase retrofitting costs. Whether the old fixture is completely removed or pushed out of the way, a new fixture frame often has to be assembled onto the grid frame to support and cleanly fit the new light fixture. This new frame can be two inches wider than the frame panel. This new frame is also an added cost.

Furthermore, existing acrylic prismatic lens 130 absorbs some light (about 10%), and it may be desirable to remove prismatic lens 130 if it is not necessary for light distribution or aesthetics. If prismatic lens 130 is removed upon retrofitting a light fixture, swing frame 120 may remain, but only to visually frame an empty plane where prismatic lens 130 had been. If swing frame 120 itself is removed, the frame hinge holes and any other unsightly grid remnants may be visible. In addition, environmentally responsible disposition of the old metal swing frames could be a concern.

It is an advantage of the present system and method that an old light fixture is replaced by a new light fixture that is more energy efficient and uses less energy to generate the same amount of light, or even a greater amount of light, than the old fixture.

Another advantage of the present system and method is that fitting a new fixture into the old frame prevents the old frame from being disposed of and reduces environmental waste.

SUMMARY

Embodiments of the present system and method include light fixtures designed for easy installation into the prismatic lens frame of the existing light fixture. Upon removal of the prismatic lens, a specially designed light fixture slides into the prismatic lens frame, where it fills in and is secured within the prismatic lens frame. In various embodiments, the prismatic lens frame is a swing frame that swings open from one side. However, the newly designed light fixture may be designed to fit within other existing frames that can receive the new light fixture within the shell of the frame, but may be opened in a way that is not necessarily considered to be a swinging motion. However, for purposes of discussion, the prismatic lens frame maybe referred to as a swing frame in some of the embodiments below.

The specially designed light fixture may be a flat panel light fixture with an optical-channel screen for uniform distribution of light-emitting diode (LED) light. The new light fixture may also be a volumetric troffer (e.g., basket) light fixture that is shallower in depth than the body of the existing (older) light fixture. In either case, the new light fixture has a thin enough profile to fit under and within the old light fixture body when the swing frame is closed. Upon closing the swing frame, the light fixture presents a new, modern light fixture while preserving the uniformity of the original swing frame. No additional installation frame needs to be assembled to secure the new light fixture in position in the T-bar grid. In fact, the existing light fixture and supporting framework can all remain in place. The use of the term prismatic lens is meant to include any type of lighting panel (acrylic or otherwise) that would sit in the swing frame of an existing fluorescent troffer light fixture.

According to some embodiments, a light fixture includes a light source (e.g., LEDs) configured to emit light, a driver configured to control operation of the light source and a body housing the light source and the driver. The body is rectangular and configured in length and width so as to slide into a prismatic lens frame of an existing light fixture installed in the ceiling, fill in the frame and be held in place by the frame, where the frame is configured to hold a translucent prismatic lens and close on the existing light fixture. The body of the new light fixture is configured in thickness and design to fit between the body of the existing light fixture and the closed frame. The body of the new light fixture is especially configured in thickness along its perimeter such that the perimeter of the body is able to slide into, fill and be held by the frame.

In some embodiments, the light fixture is a flat panel light fixture with an optical channel screen (e.g., optical polymethyl methacrylate or PMMA) that evenly distributes light on a front side of the body (e.g., with reflective material like aluminum on the internal back side), and the driver may be located on the external back side of the body. In other embodiments, the body comprises a volumetric troffer body, or basket, shaped to reflect or disperse light from a light source and the light source is attached to a front side of the basket. The driver may also be placed directly on the existing light fixture or located separately from the body.

According to some embodiments, a method of replacing a translucent prismatic lens, held in a prismatic lens frame of an existing light fixture installed in a ceiling, with a new light fixture that comprises a body that houses a light source and a driver, includes opening the frame, removing a side of the frame and sliding out the prismatic lens. The method further includes sliding the new light fixture into the frame and re-attaching the side of the frame, where the light fixture fills in the frame and is held in place by the frame. The method also includes enabling power to the driver of the new light fixture and then closing the frame, where the body of the light fixture fits between the body of the existing light fixture and the closed frame.

According to an embodiment, a method of replacing a portion of a troffer light system with a more efficient new light fixture is contemplated. The troffer light system comprises: a metal housing; a frame attached to metal housing; a lens; one or more fluorescent lighting elements; and a ballast. The method includes removing the lens from the frame, placing the new light fixture in the frame, and securing the light fixture to the frame. The fluorescent lighting elements and ballast are removed and the new light fixture is connected to a source of power. The frame is closed and the removed parts are diposed of or recycled. Disposing of or recycling the parts removed from the troffer light system disposes or recycles less than 50 percent of the troffer light system by weight.

Of course, the present invention is not limited to the above features and advantages. Those of ordinary skill in the art will recognize additional features and advantages upon reading the following detailed description, and upon viewing the accompanying drawings.

DETAILED DESCRIPTION

Some drop down ceilings have volumetric troffer light fixtures that are covered by an acrylic prismatic lens that absorbs some of the light and spreads the rest. Some of these troffer light fixtures are completely removed and replaced in light fixture upgrade projects. Complete replacement can increase retrofitting costs. Whether the old fixture is completely removed or pushed out of the way, a new grid frame may also have to be assembled under the new light fixture on or under the existing grid frame to support and cleanly fit the new light fixture. Furthermore, the existing acrylic panel absorbs some amount of light and it may be desirable to remove the panel if it is not necessary for light distribution or aesthetics. However, an empty or missing prismatic lens frame may be undesirable. In addition, one needs to take care not to discard the metal light frames (and any other old light fixture components) in an environmentally irresponsible way.

Figure 1A:
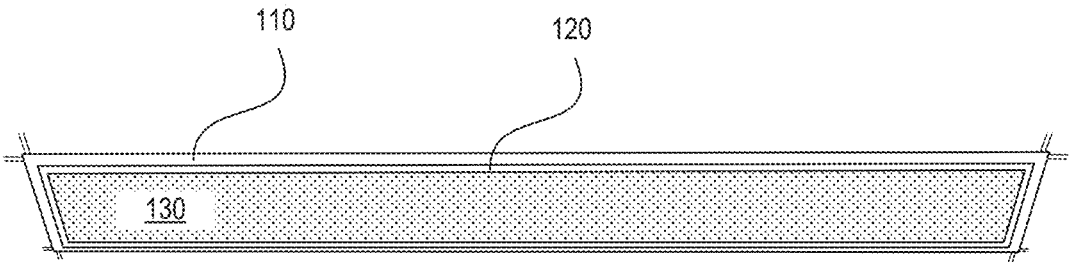
FIG. 1A is a perspective view of a troffer light fixture.
Figure 1B:
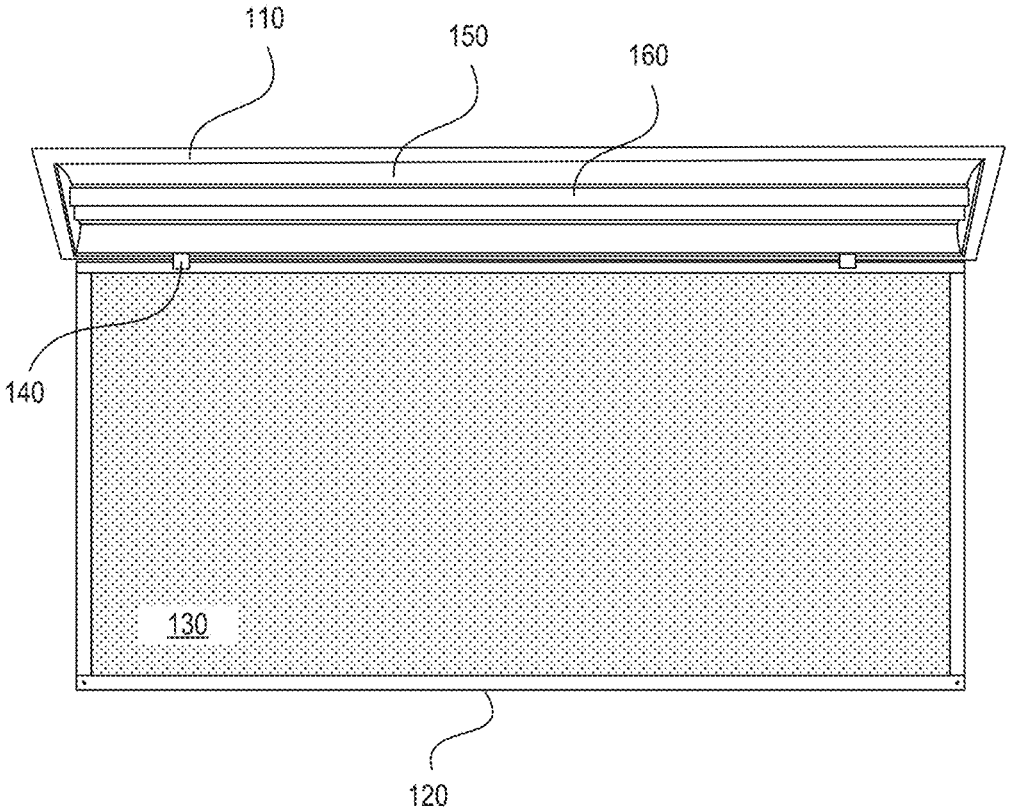
FIG. 1B illustrates the troffer light fixture with its prismatic lens swing frame in the open position.
Figure 2:
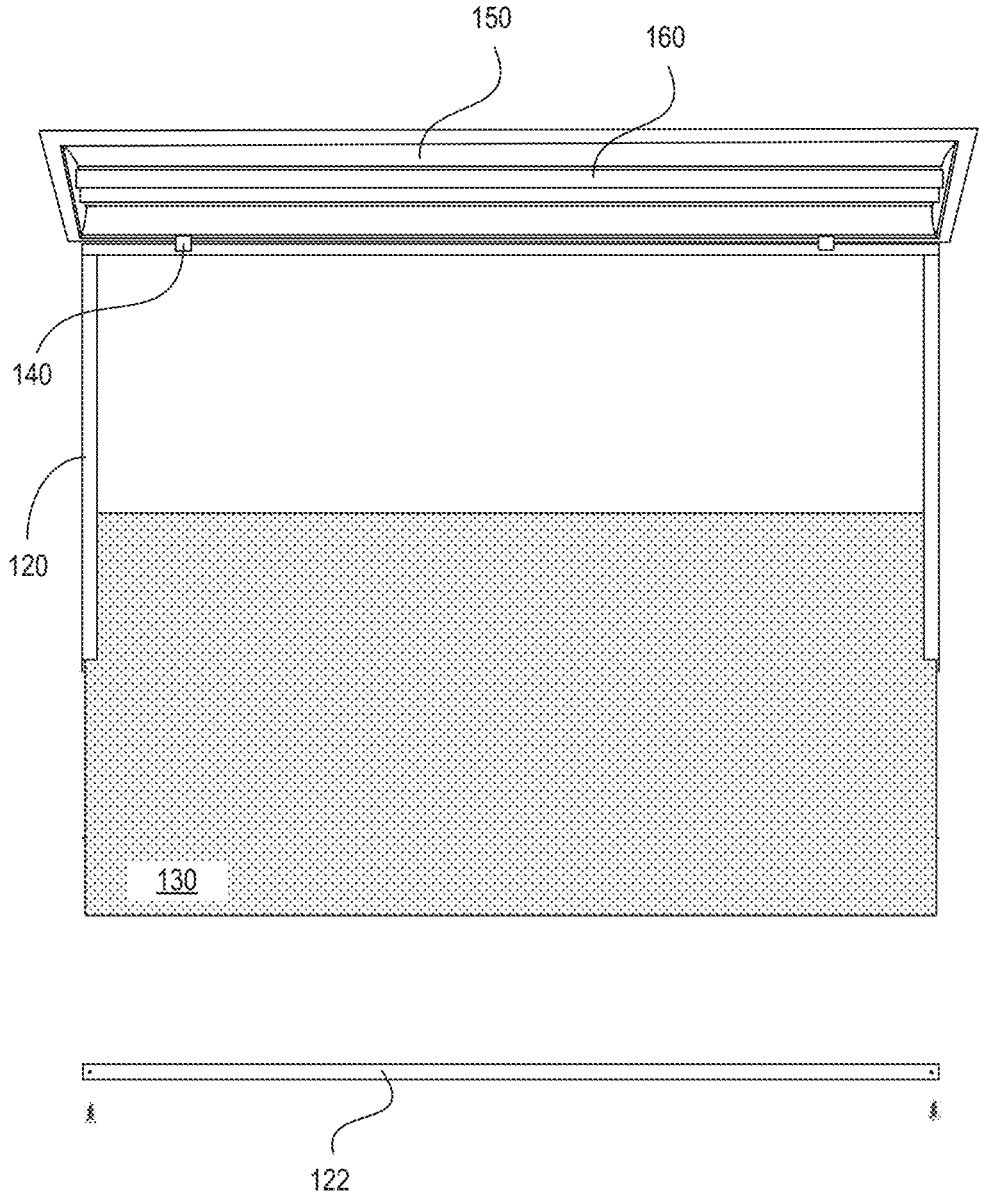
FIG. 2 illustrates the removal of a lower side of the swing frame and removal of the prismatic lens.
Figure 4:
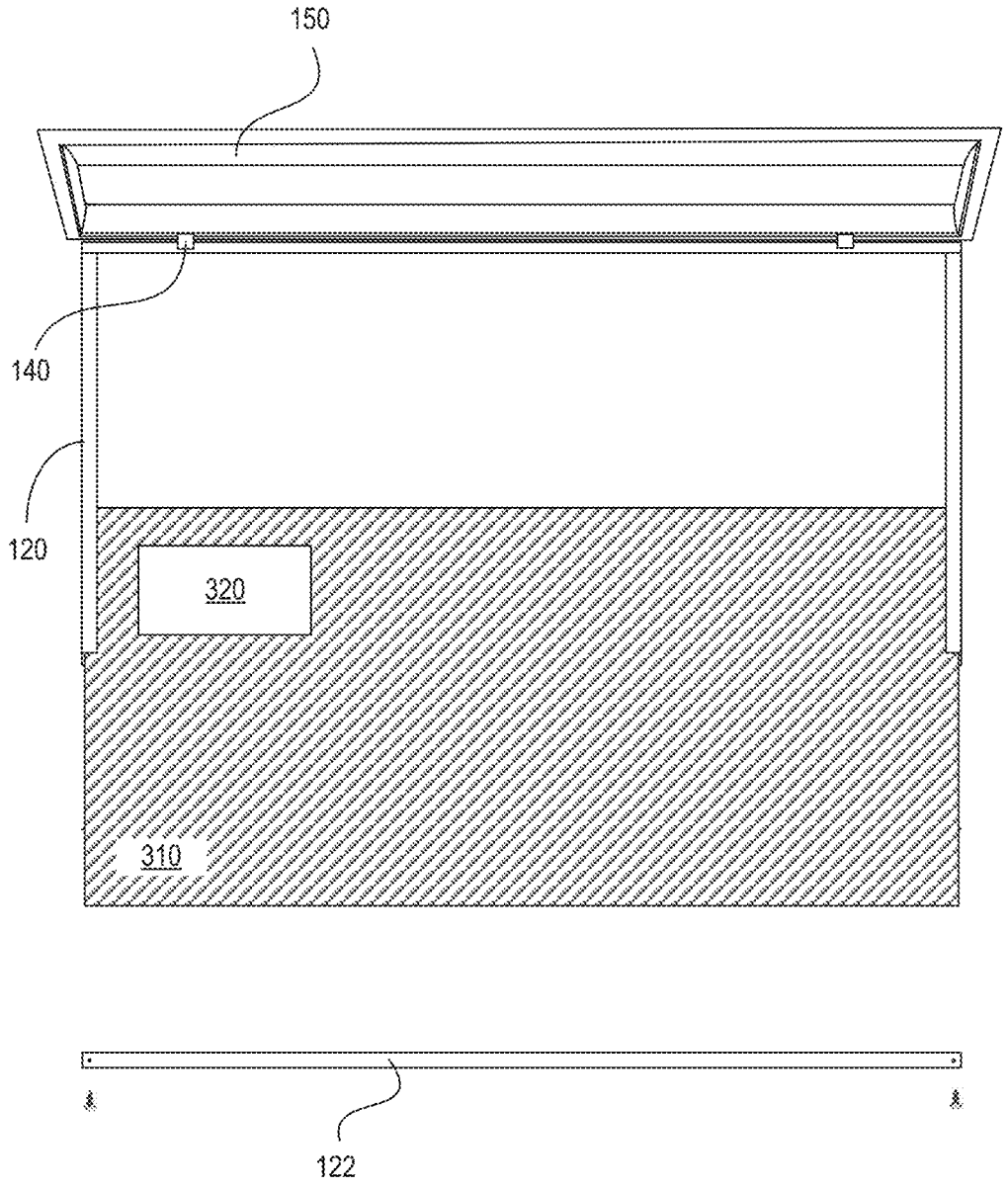
FIG. 4 illustrates installation of the flat panel light fixture into the swing frame, according to some embodiments.

Embodiments of the present system and method are directed to light fixtures that are specifically designed for easy installation into the prismatic lens frame of an existing light fixture. FIG. 2 shows removal of a lower side 122 of swing frame 120, allowing translucent prismatic lens 130 to slide out. Upon removal of prismatic lens 130, a specially configured light fixture 310 slides into swing frame 120, where it is secured within swing frame 120. This is shown in FIG. 4. This specially configured light fixture 310 may be a flat panel light fixture with an optical-channel screen for uniform distribution of LED light. This specially configured light fixture 310 may also be a volumetric troffer or basket light fixture that is shallower in depth than the existing troffer body. In either case, new light fixture 310 has a thin enough profile at its thickest to fit under and within troffer body 150 of the existing light fixture when swing frame 120 is closed. Upon closing swing frame 120, light fixture 310 presents a new, modern light fixture while preserving the consistency or uniformity of original swing frame 120. No additional grid or installation frame needs to be assembled to secure new light fixture 310 in position in the grid. In fact, the existing light fixture and supporting framework can likely all remain in place.

According to some embodiments, a new light fixture includes a light source configured to emit light, a driver configured to control operation of the light source and a body housing the light source and the driver. The body may be rectangular and configured in length and width so as to slide into a prismatic lens frame of an existing light fixture installed in a ceiling, fill in the frame and be held in place by the frame, where the frame is configured to hold a translucent prismatic lens and close on the existing light fixture. The body is configured to fit between the body of the existing light fixture and the closed frame. The body of the new light fixture is configured in thickness along the perimeter of the body such that the perimeter of the body is able to slide into, fill and be held by the frame.

In some embodiments, the light fixture may be a flat panel light fixture. The light source may be one or more LEDs, such as one or more LED strips. The strips of LEDs may be placed on at least two sides within the body of the fixture and may be thin enough or placed on the edges in such a way that the perimeter of the flat panel light fixture may slide in to a prismatic lens frame and be held in place by the frame. The overall thickness of the flat panel may make this possible, or the perimeter may be configured to be slightly thinner than the rest of the body.

Figure 3A:
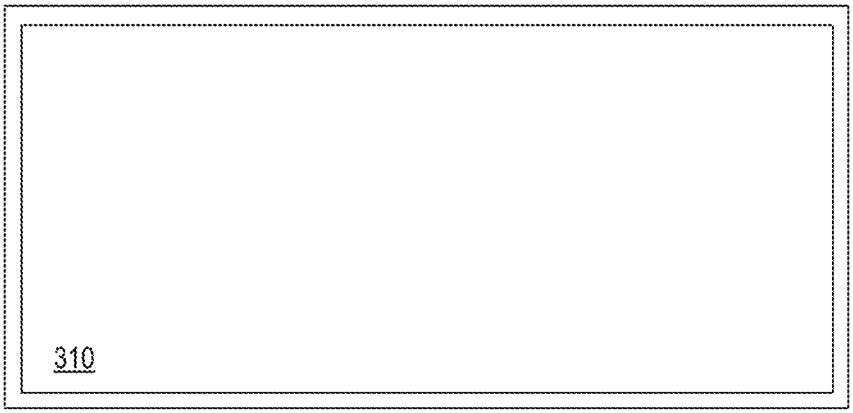
FIG. 3A illustrates a front view of a flat panel light fixture that is specifically configured to fit in the swing frame, according to some embodiments.
Figure 3B:
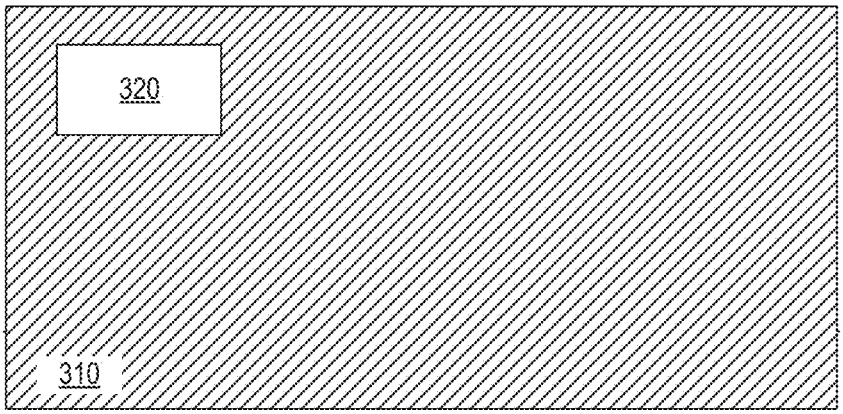
FIG. 3B illustrates a back view of the flat panel light fixture that is configured to fit in the swing frame, according to some embodiments.
Figure 3C:
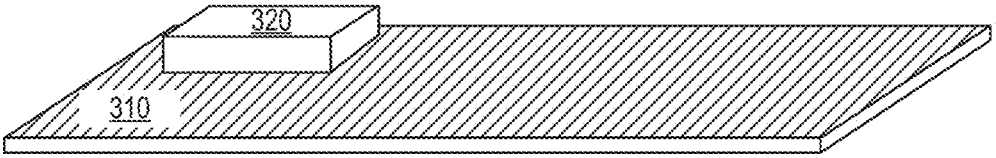
FIG. 3C illustrates a perspective view of the flat panel light fixture that is specifically configured to fit in the swing frame, according to some embodiments.

The body of the flat panel light fixture may have an optical channel screen that evenly distributes light on a front side of the body. FIG. 3A illustrates an example of a front side of a new light fixture 310 that is a flat panel light fixture. The body may house driver 320 for the light source on a back side of the body. Driver 320 may be placed on the back side of the body so that, when new light fixture 310 slides into a frame such as swing frame 120 and swing frame 120 is closed, driver 320 on the back side of the body does not bump up against previously installed or existing troffer body 150 and impede the closing of swing frame 120. FIGS. 3B and 3C illustrate a back side of the body and an example of a placement of driver 320. In some cases, driver 320 is placed towards the edge of the body (but not to impede the sliding of the fixture into the panel). In other cases, driver 320 is placed so as to avoid hitting existing troffer body 150 or any unremoved bulb or ballast in a middle portion of the existing light fixture. In some cases, driver 320 is placed in the middle.

Figure 5A:
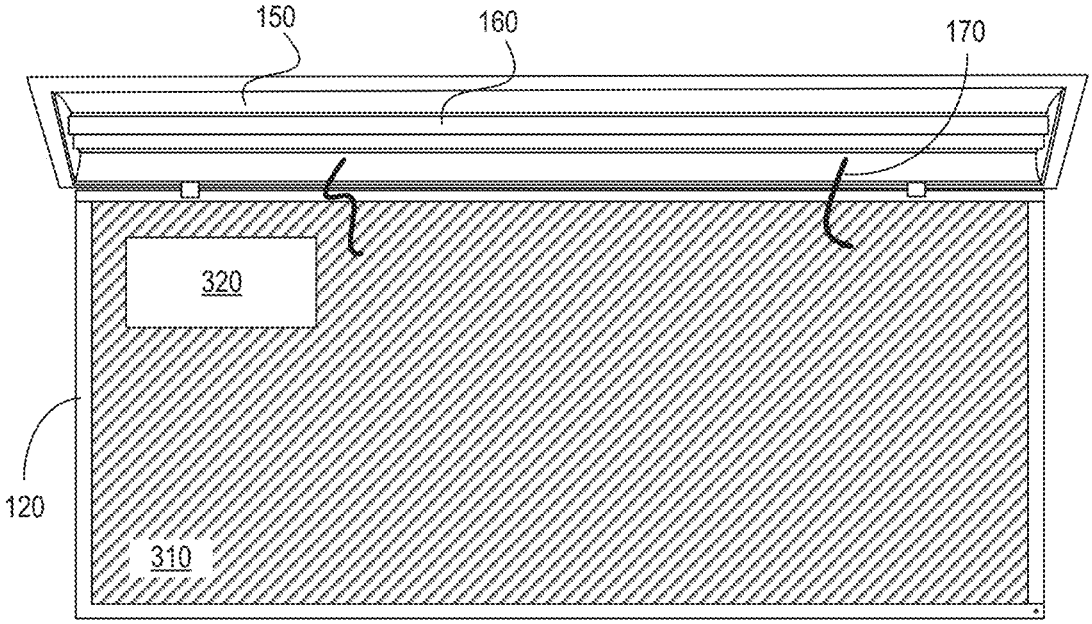
FIG. 5A also illustrates installation of the flat panel light fixture into the swing frame, according to some embodiments.
Figure 5B:
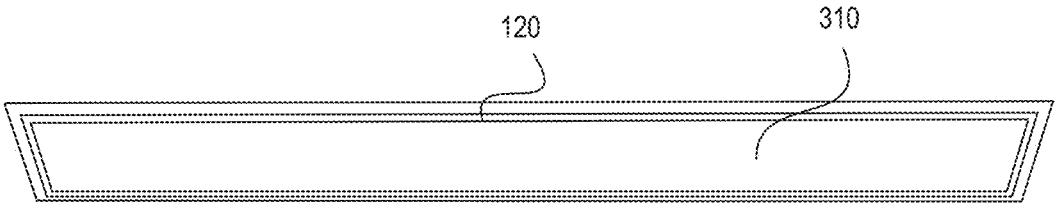
FIG. 5B illustrates a perspective view of the flat panel light fixture upon completion of the installation, according to some embodiments.
Figure 6:
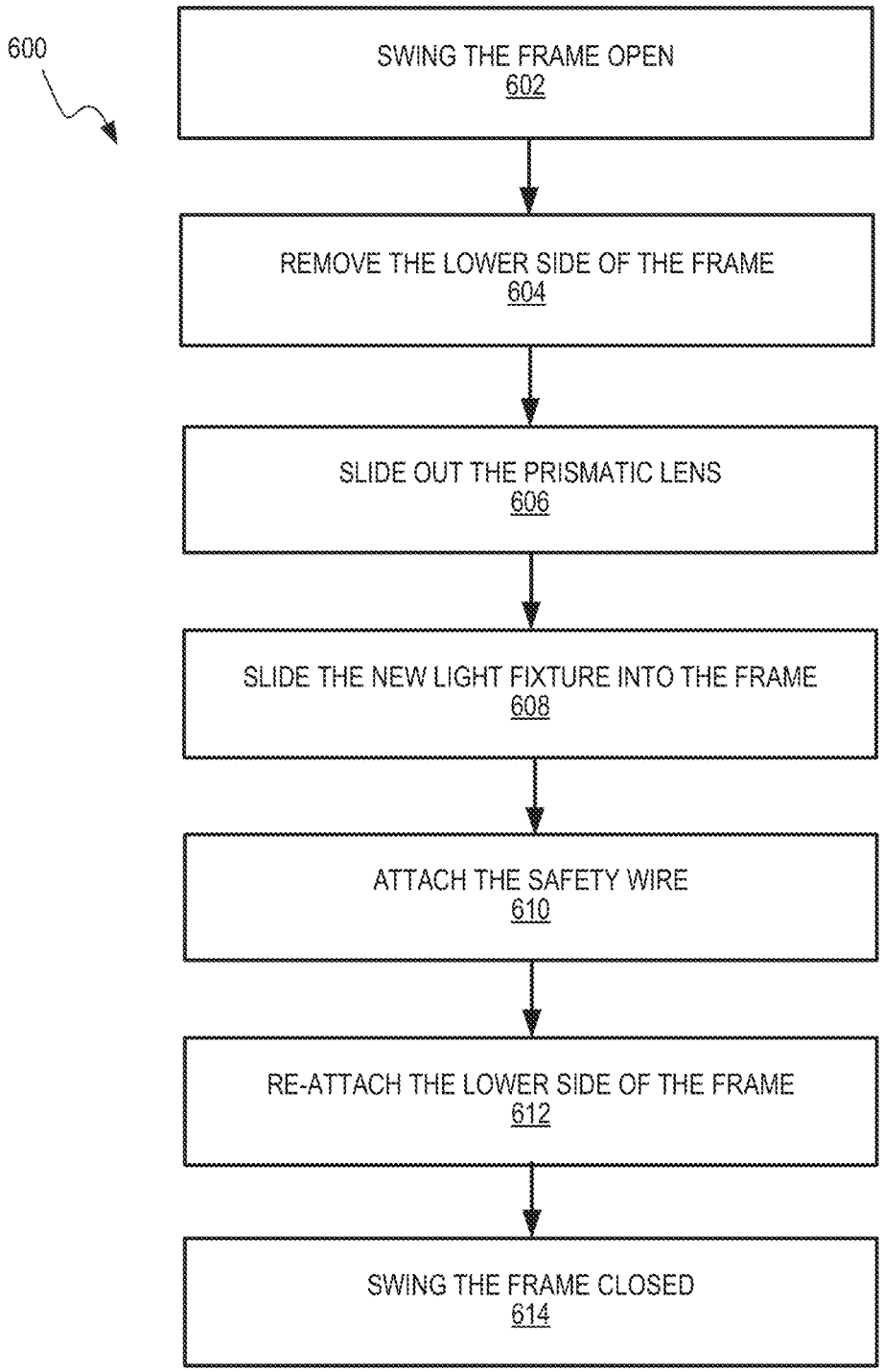
FIG. 6 illustrates a method of installing a light fixture that is specifically configured to fit in a prismatic lens swing frame, according to some embodiments.

FIGS. 4 and 5A-5B illustrate an example of how a translucent prismatic lens, held in a prismatic lens swing frame of a troffer body light fixture installed in a ceiling, is replaced with a flat panel light fixture 310 that comprises a body that houses a light source and a driver. FIG. 6 illustrates a flowchart of this method.

According to some embodiments, method 600 of FIG. 6 includes swinging the swing frame 120 open (step 602). This may involve unlatching swing frame 120 so that swing frame 120 can open. Method 600 then includes removing lower side 122 of swing frame 120 (step 604), the side being lower as it is furthest from the ceiling when swing frame 120 is open. FIG. 4 shows how lower side 122 of swing frame 120 can be removed. This may be done by removing the screws (or clips) holding lower side 122 to swing frame 120. Method 600 then includes sliding out existing prismatic lens 130 (step 606).

At this point, other components of the installed troffer light may be removed. This may include removal of the fluorescent tubes, the ballast and any other components that may be underneath troffer light fixture body 150. The wires that will power driver 320 of new light fixture 310 may also be made accessible. Existing troffer body 150 or any portion of it may also be removed, as long as the hinge holes/mounts remain for swing frame 120.

Method 600 then includes sliding new light fixture 310 into swing frame 120 (step 608). This is also shown by FIG. 4. New light fixture 310 is configured so that the edges of the body of light fixture 310 are narrow enough to slide into swing frame 120. Light fixture 310 may be attached to existing troffer body 150, the T-bar grid or another connection point with one or more safety cords or wires 170 (step 610). FIG. 5A shows these safety wires 170. Although not necessary, these safety wires 170 may provide an additional layer of attachment in the event that swing frame 120 is shaken loose from existing troffer body 150 or the T-bar grid during installation, because of an earthquake or due to some other work that is being performed on the ceiling.

Method 600 further includes re-attaching lower side 122 of swing frame 120 (step 612). New light fixture 310 fills in swing frame 120 and is held in place by swing frame 120. New light fixture 310 fills swing frame 120 so that there are no gaps between the edges of light fixture 310 and the area within swing frame 120. This is also shown by FIG. 5A. Because light fixture 310 is big enough to fill swing frame 120, light fixture 310 will not fall out of swing frame 120. Swing frame 120 holds light fixture 310 in place. New light fixture 310 may be long enough and wide enough to fill out a frame for a 2 ft. by 4 ft. space, but short enough to fit into the frame. In some cases, the frame may be only for a 2 ft. by 2 ft. space.

Note that "fill in" is meant to indicate that the perimeter of new light fixture 310 fits into enough of the shell of swing frame 120 so that existing troffer body 150 is not visible when swing frame 120 is closed. The term "fill in" is not meant to require that the shell of swing frame 120 is filled in so that all of the edges of new light fixture 310 abuts against all of the walls of the shell of swing frame 120. It is just that enough of the edges of new light fixture 310 is held inside the shell of swing frame 120 such that new light fixture 310 cannot fall out of swing frame 120 upon some movement or manipulation of new light fixture 310 when swing frame 120 is closed.

In some cases, new light fixture 310 needs to be shorter than the usual 585 mm or 602 mm length, in order to fit in swing frame 120. In fact, the size of such a fixture may be shortened by 2 inches in length and 1½ inches in width if necessary to fit within swing frame 120.

Method 600 also includes enabling power to driver 320. In one embodiment, this includes connecting the driver 320 to power wires that power the light fixture already installed in the ceiling. Quick disconnect wires may be used to establish the electrical connection. In another embodiment, the power wires may be terminated or left in place in the existing troffer light fixture. This may be because driver 320 carries its own power source or has a different connection to a power source. In another embodiment, the driver 320 includes an adapter that connects to sockets in the light fixture already installed in the ceiling. One advantage of this embodiment is that it enables an installer to easily provide power to the driver 320 without needing additional tools and changing the wiring of the light fixture.

Figure 5C:
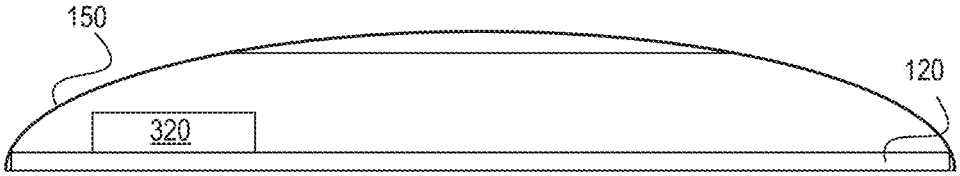
FIG. 5C illustrates an internal view of an existing troffer body upon completion of the installation of the flat panel light fixture, according to some embodiments.

The remaining step may be closing swing frame 120 (step 614). Closing swing frame 120 may involve swinging swing frame 120 closed and then re-latching it. The body of new light fixture 310 fits between body 150 of the existing light fixture and closed swing frame 120. This is made possible by the design and placement of driver 320 on the back side of the body of new light fixture 310. FIG. 5B shows new flat panel light fixture 310 installed in the ceiling. FIG. 5C shows how new flat panel light fixture 310 and its driver 320 fit between body 150 of the old light fixture and swing frame 120 when swing frame 120 is closed.

Figure 7A:
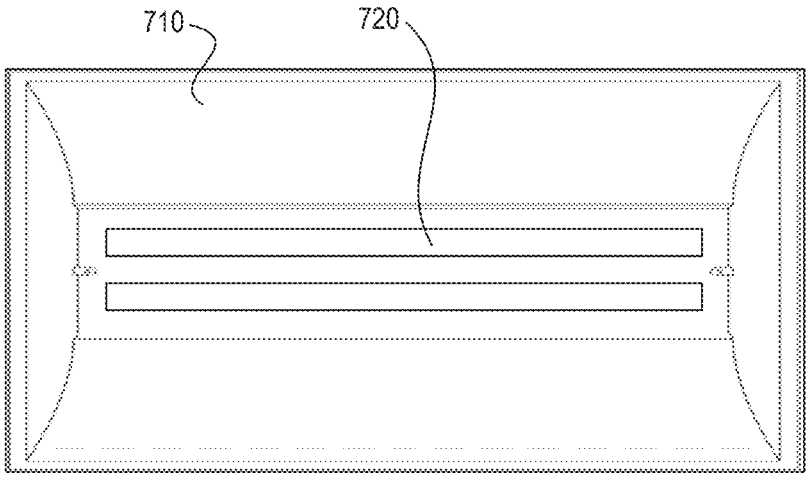
FIG. 7A illustrates a front view of a shallow volumetric basket light fixture that is specifically configured to fit in the swing frame, according to some embodiments.
Figure 7B:
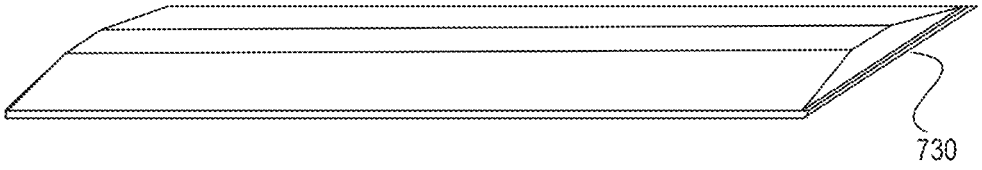
FIG. 7B illustrates a perspective view of the back of the volumetric basket light fixture that is specifically configured to fit in the swing frame, according to some embodiments.

In other embodiments, the light fixture may be a volumetric troffer light fixture with a body 710 shaped to reflect or disperse light from a light source 720, where light source 720 is attached to a front side of troffer body 710 that will face down from the ceiling. This front side is shown in FIG. 7A. However, this new troffer body 710 is shallower or thinner than the space underneath existing troffer body 150. This will allow swing frame 120 to close with new troffer body 710. FIG. 7B shows how new troffer body 710 is thinner than old troffer body 150. For example, troffer body 710 for the new volumetric basket may be about 2½ inches thick, while the space between existing troffer body 150 and closed swing frame 120 may be 3-4 inches. Troffer body 710 has a perimeter 730, where enough of perimeter 730 is thin enough to slide into swing frame 120.

Figure 8:
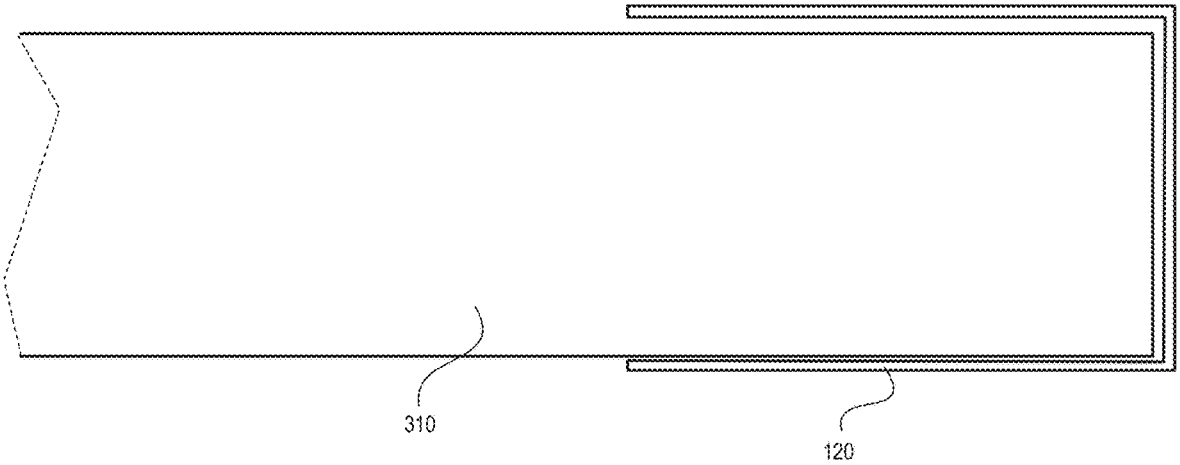
FIG. 8 illustrates a close-up view of how the edge of a flat panel light fixture is configured to slide within and be held in place by the swing frame, according to some embodiments.
Figure 9:
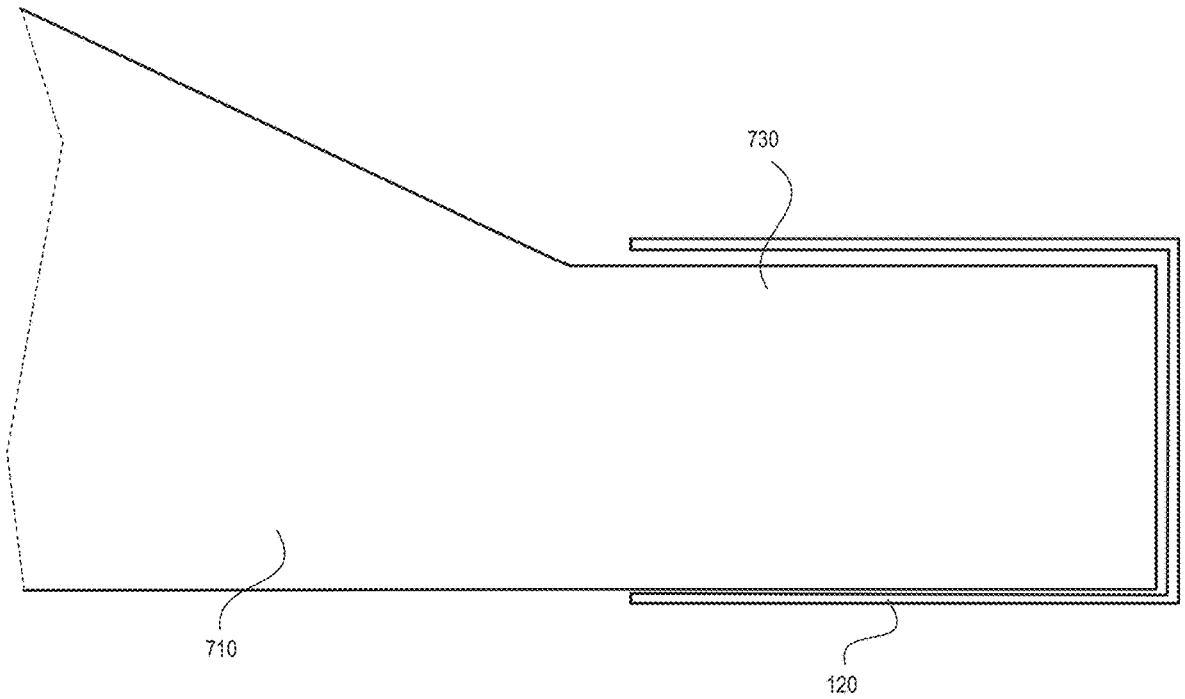
FIG. 9 illustrates a close-up view of how the edge of a basket light fixture is configured to slide within and be held in place by the prismatic lens frame, according to some embodiments.

FIG. 8 illustrates a cross-sectional close-up view of how the edge of a flat panel light fixture 310 is configured to slide within and be held in place by swing frame 120, according to some embodiments. FIG. 9 illustrates a cross-sectional close-up view of how perimeter 730 of a volumetric troffer body light fixture 710 is configured to slide within and be held in place by swing frame 120, according to some embodiments. In each case, a portion of troffer body light fixture 710 along all of perimeter 730 may be configured to be thin enough to fit into the shell of swing frame 120. The thickness may be about ¾ inch or less, or at least thinner than the inside shell of swing frame 120. In some cases, at least an inch from the very edge, all around the perimeter, may be thin enough to fit into swing frame 120. FIG. 9 shows, for example, about an inch of perimeter 730 of light fixture body 710 fitting into the shell of swing frame 120.

Figure 10:
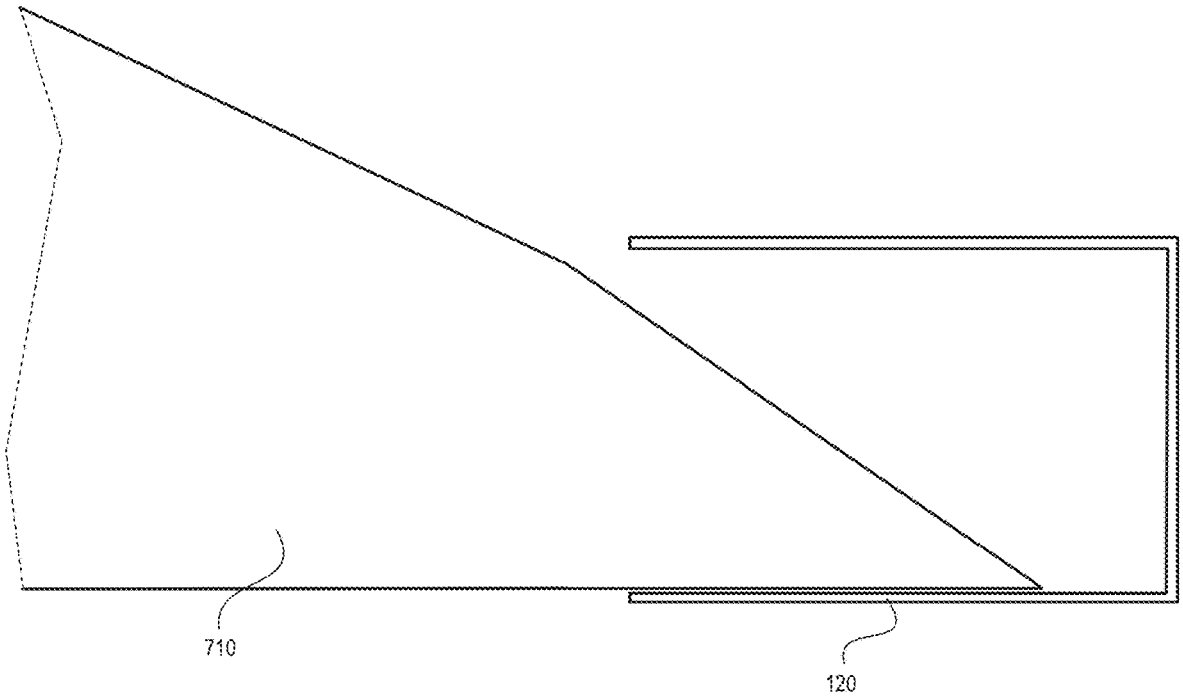
FIG. 10 illustrates another close-up view of how the edge of a basket light fixture is configured to slide within and be held in place by the prismatic lens frame, according to some embodiments.

FIG. 10 illustrates another close-up view of how the edge of a basket light fixture is configured to slide within and be held in place by swing frame 120, according to some embodiments. Note how light fixture body 710 is considered to fill in swing frame 120, even though the edges of light fixture body 710 do not completely abut against the inside walls of the shell of swing frame 120. Enough of light fixture body 710 fills in the shell of swing frame 120 to keep light fixture body 710 safely secure within swing frame 120.

Figure 11:
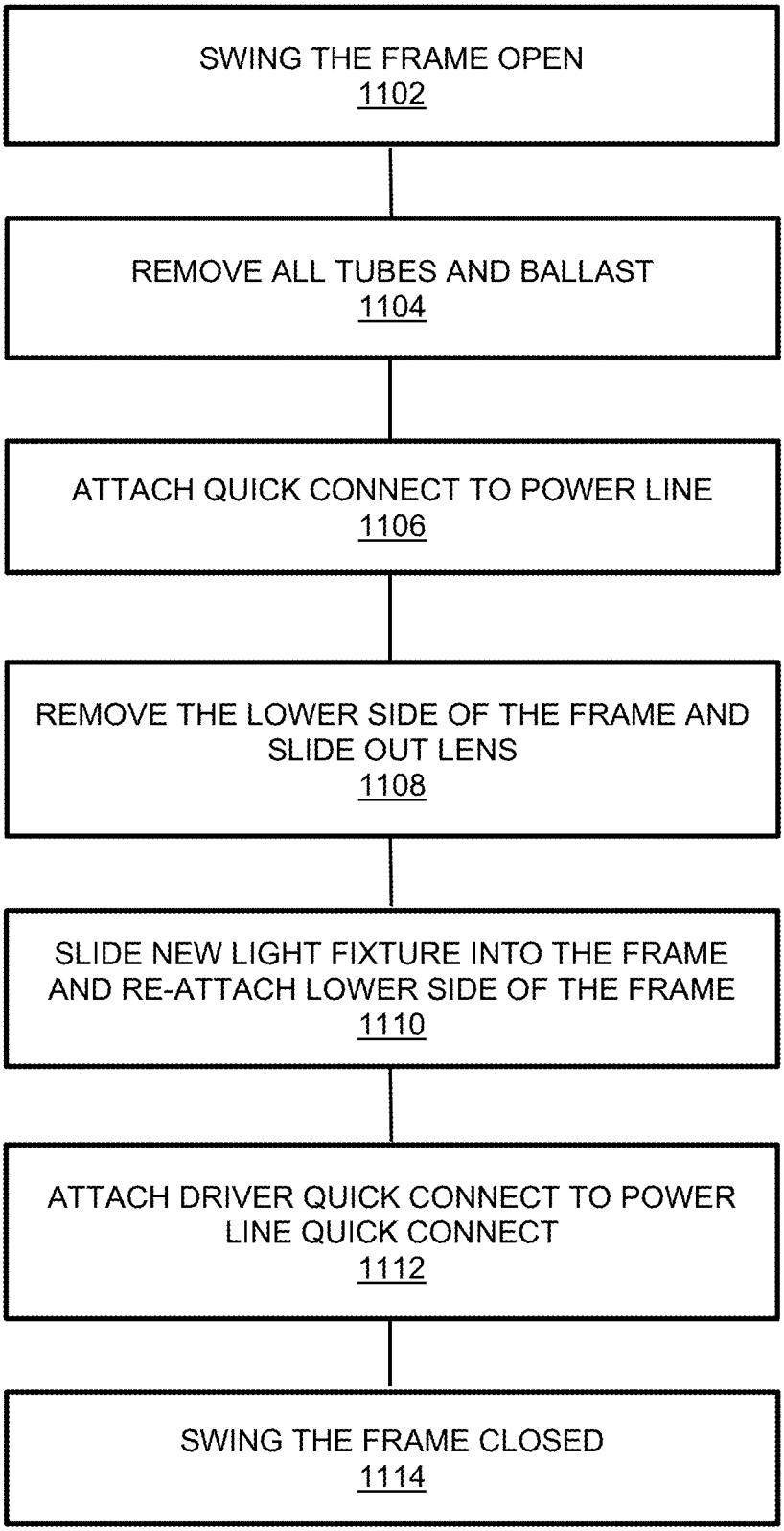
FIG. 11 illustrates a method of installing a light fixture that is specifically configured to fit in a lens swing frame, according to another embodiment.
Figure 12:
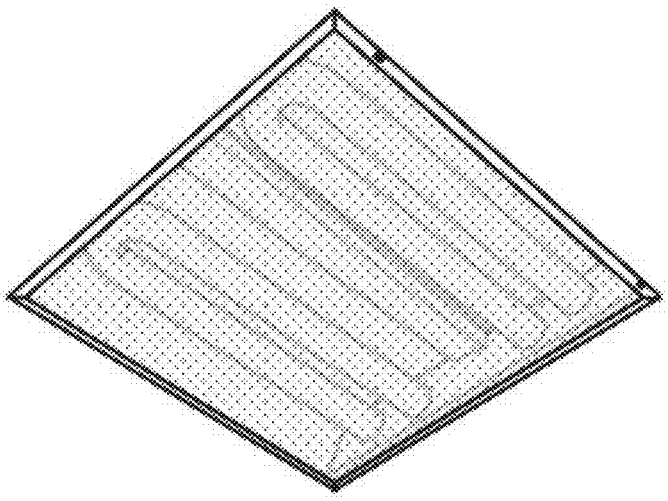
FIG. 12 (prior art)
FIG. 12 illustrates a conventional light fixture.
Figure 13:
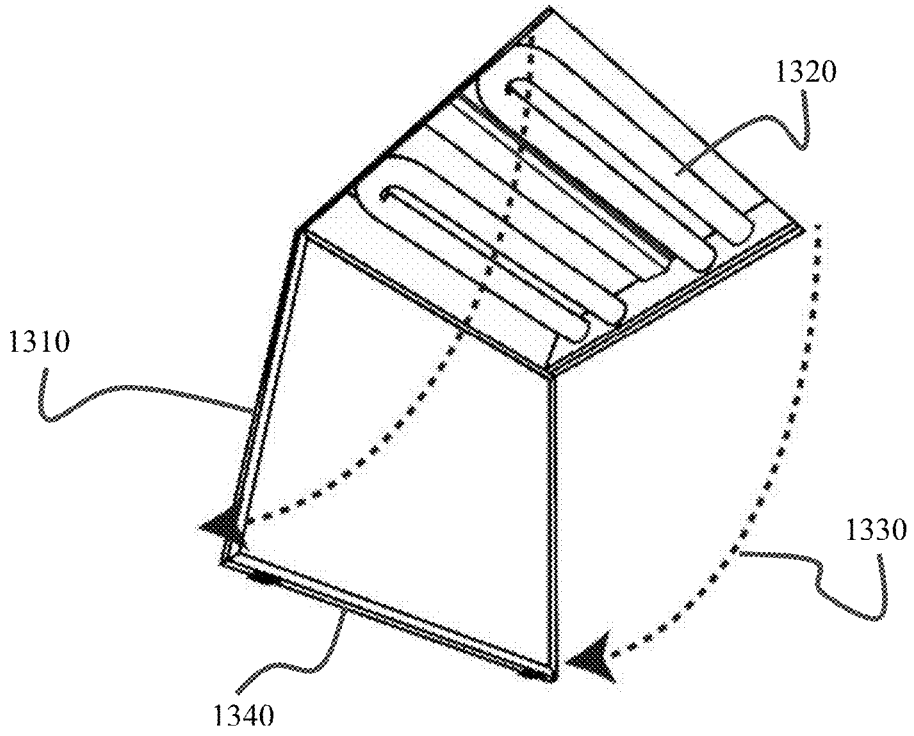
FIG. 13 illustrates step 1102 in the method illustrated in FIG. 11.

FIG. 12 shows one example of a conventional light fixture that is found in office buildings and residential homes. FIGS. 11 and 13 to 14 illustrate another method of installing a light fixture that is specifically configured to fit in a lens swing frame, such as one shown in FIG. 12. The method includes swinging the lens swing frame 1310 into an open position (step 1102 and FIG. 13) and removing the light tubes 1320 and the ballast 1410 (step 1104). Removing the ballast 1402 is desirable because ballasts are used to limit the current provided to the light tube 1320 and are not necessary to for the new light fixture. Furthermore, ballasts can cause safety issues and ballasts have burst or caused electrical fires. Light tubes 1320 are shown as u-shaped light tubes, however other shaped light tubes may be present in the conventional light fixture. For example, light tubes 1320 may be cylindrical in shape or circular in shape.

After the ballast 1410 is removed the power line 1420, that is connected to the ballast and provides electricity to the ballast, is exposed. A quick connect 1430 is attached to the power line 1420 (step 1106 and FIG. 14B). The quick connect 1430 may be attached to the power line 1420 using any methods known in the art to attach a connection point to wire or electrical line.

Figure 14A:
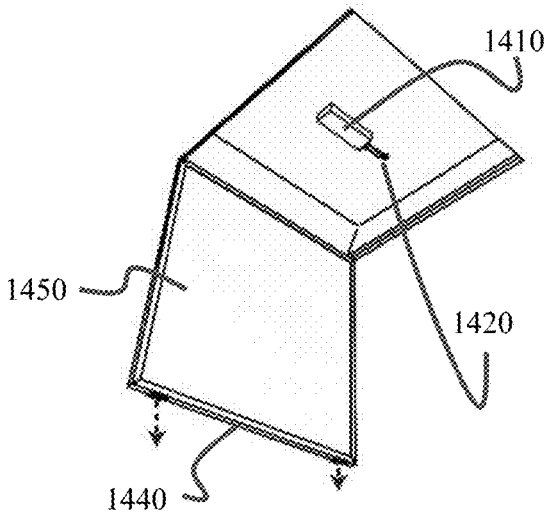
FIGS. 14A-E illustrate steps 1106, 1108, 1110, 1112, and 1114 in the method illustrated in FIG. 11.
Figure 14B:
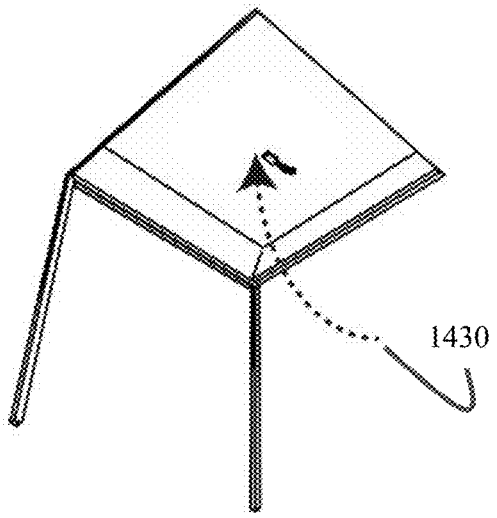
Figure 14C:
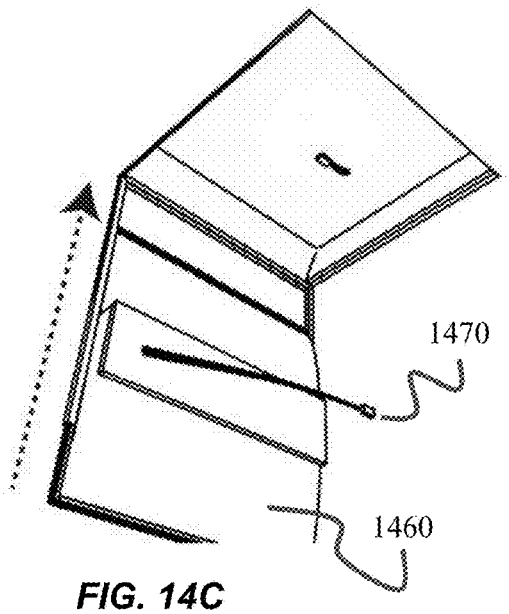
Figure 14D:
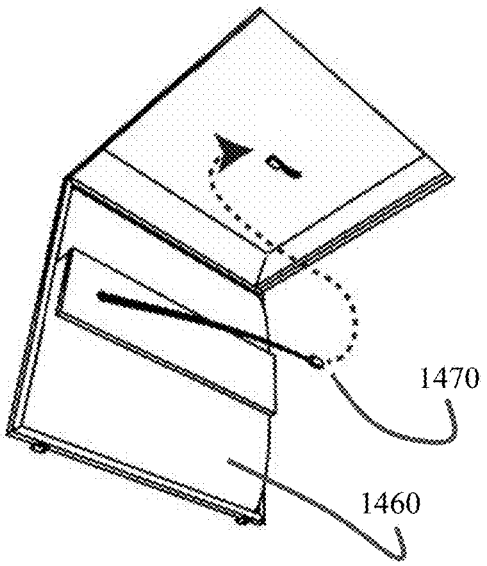
Figure 14E:
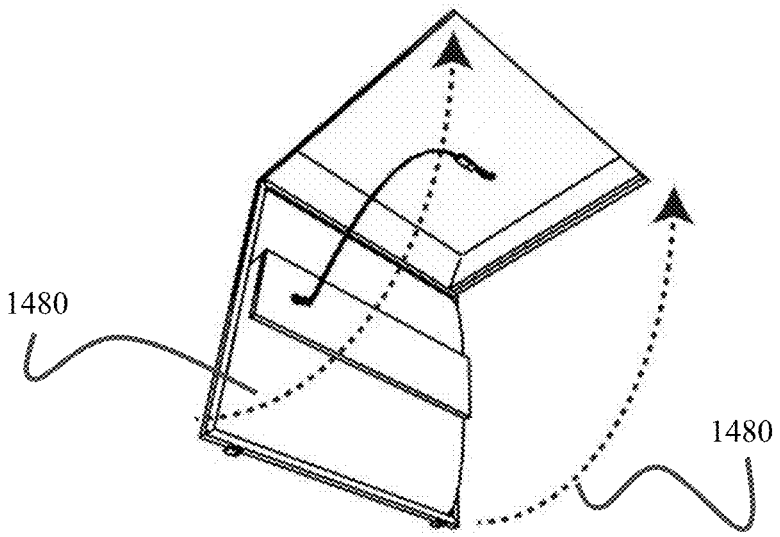
Figure 15:
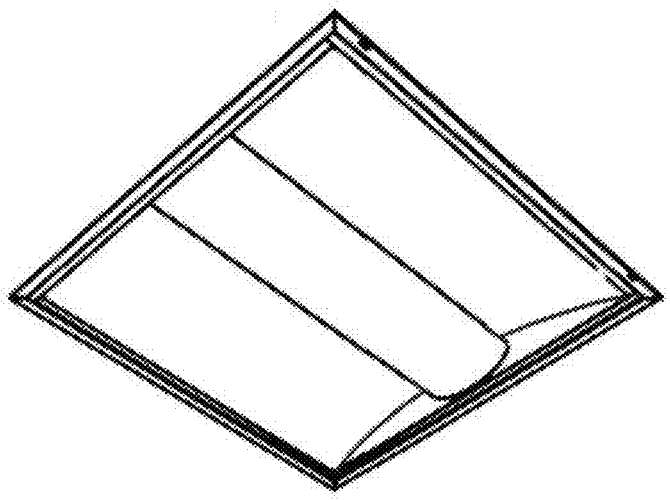
FIG. 15 illustrates a new light fixture installed in the frame of an existing light fixture.

The lower side 1440 of the frame 1310 is removed and the lens 1450 is slid out of the frame (step 1108 and FIG. 14A). This leaves the frame 1310 empty, as shown in FIG. 14B. The new light fixture 1460 is slid into the empty frame and the lower side 1440 is reattached to the frame 1310 (step 1110 and FIG. 14D). The driver quick connect 1470 is attached to the power line quick connect 1430, enabling power to be supplied to the driver (step 1112 and FIG. 14D). The frame is the swung closed in the direction shown by arrows 1480 (step 1114 and FIG. 14E). Once closed, the new light fixture 1460 is mounted in the ceiling and held by the frame 1310, as shown in FIG. 15.

In one embodiment, the light fixture 1460 is substantially rectangular in shape. This means that the shape has opposing sides have lengths that are within 2% of each other and that the angles between the sides are in a range 88-92 degrees.

In one embodiment, the driver 320 is a smart driver that may be connected to a network or a computing device via a wireless connection. The smart driver is programmable to enable the network or computing device to control the lighting and create lighting effects. The lighting effects may include one or more features such as brightness, color, or strobing. The computing device may be a mobile computing device, such as a mobile phone, a tablet, or a laptop, a desktop computing device, or a smart speaker. Any suitable wireless connection, such as wife or Bluetooth may be used.

In one embodiment, a method of replacing a portion of a troffer light system with a more efficient new light fixture is contemplated. The troffer light system comprises: a metal housing; a frame attached to metal housing; a lens; one or more fluorescent lighting elements; and a ballast. The method includes removing the lens from the frame, placing the new light fixture in the frame, and securing the light fixture to the frame. The fluorescent lighting elements and ballast are removed and the new light fixture is connected to a source of power. The frame is closed and the removed parts are disposed of or recycled. Disposing of or recycling the parts removed from the troffer light system disposes or recycles less than 50 percent of the troffer light system by weight. Depending on design of the troffer light system, disposing of or recycling the removed parts may dispose 5-50 percent of the troffer light system, by weight or volume.

Of course, the present invention is not limited to the above features and advantages. Those of ordinary skill in the art will recognize additional features and advantages upon reading the following detailed description, and upon viewing the accompanying drawings.

Notably, modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only and not for purposes of limitation.

What is claimed is:

1. A method of replacing a translucent prismatic lens, held in a frame of an existing light fixture installed in a ceiling, with a light fixture, the method comprising:

opening a frame of an existing light fixture, wherein the frame is a swing frame configured to hold a prismatic lens therein;

removing a side of the swing frame;

removing the prismatic lens from the swing frame;

sliding a light fixture into the swing frame, wherein the light fixture comprises a body that houses a light source and has a driver mounted thereon;

re-attaching the side of the swing frame, wherein the light fixture fills in the swing frame and is held in place by the swing frame;

enabling power to the driver; and closing the swing frame, wherein the body of the light fixture fits between a body of the existing light fixture and the closed swing frame.

2. The method of claim 1, further comprising attaching a safety wire from the body of the light fixture to a grid of the ceiling or the body of the existing light fixture.

3. The method of claim 1, further comprising removing at least one of a light bulb, a driver, and a ballast of the existing light fixture.

4. The method of claim 1, wherein removing the prismatic lens comprises sliding the prismatic lens out of the swing frame.

5. The method of claim 1, wherein enabling power to the driver comprises electrically connecting the driver to a source of power in the existing light fixture.

6. The method of claim 5, wherein the driver is connected to electrical wiring of the existing light fixture.

7. The method of claim 6, wherein the driver is connected to one or more socket of the existing light fixture.

8. The method of claim 1, wherein enabling power to the driver comprises providing the driver with a new source of power.

9. The method of claim 1, wherein the light sources comprises at least one light emitting diode (LED).

10. The method of claim 1 further comprising:

removing a ballast from the existing light fixture, wherein removing the ballast results in exposing an existing power line; and attaching a first quick connector to the existing power line.

11. The method of claim 10, wherein enabling power to the driver comprises connecting a second quick connector to the first quick connector, wherein the second quick connector is attached via a wire to the driver.

12. A method of replacing a portion of a troffer light system with a more efficient new light fixture, wherein the troffer light system comprises: a metal housing; a frame attached to metal housing; a lens; one or more fluorescent lighting elements; and a ballast, the method comprising:

removing the lens from the frame;

placing the new light fixture in the frame and securing the light fixture to the frame;

removing the one or more fluorescent lighting elements;

removing the ballast;

connecting the new light fixture to a source of power;

closing the frame; and disposing of or recycling parts removed from the troffer light system, wherein disposing of or recycling the parts removed from the troffer light system disposes or recycles less than 50 percent of the troffer light system by weight.

* * * * *